US011643871B2

(12) United States Patent
Zhou

(10) Patent No.: US 11,643,871 B2
(45) Date of Patent: May 9, 2023

(54) IDLER END FOR A ROLLER BLIND

(71) Applicant: LES ENTREPRISES SMARTLUX INC., Saint-Laurent (CA)

(72) Inventor: Fan Zhou, Montreal (CA)

(73) Assignee: LES ENTREPRISES SMARTLUX INC., Saint-Laurent (CA)

( * ) Notice: Subject to any disclaimer, the term of this patent is extended or adjusted under 35 U.S.C. 154(b) by 102 days.

(21) Appl. No.: 17/227,255

(22) Filed: Apr. 9, 2021

(65) Prior Publication Data

US 2021/0317703 A1 Oct. 14, 2021

(30) Foreign Application Priority Data

Apr. 10, 2020 (CA) ..... CA 3077999

(51) Int. Cl.
*E06B 9/42* (2006.01)

(52) U.S. Cl.
CPC ..... *E06B 9/42* (2013.01)

(58) Field of Classification Search
CPC ..... E06B 9/42; E06B 9/40
USPC ..... 160/323.1
See application file for complete search history.

(56) References Cited

U.S. PATENT DOCUMENTS

| | | | | |
|---|---|---|---|---|
| 3,340,922 | A * | 9/1967 | Anderson | E06B 9/44 160/326 |
| 9,222,305 | B2 * | 12/2015 | Di Stefano | E06B 9/68 |
| 9,238,939 | B2 * | 1/2016 | Di Stefano | E06B 9/42 |
| 9,926,740 | B2 * | 3/2018 | Pham | E06B 9/42 |
| 10,745,966 | B2 * | 8/2020 | Chen | E06B 9/42 |
| 11,215,007 | B2 * | 1/2022 | Schorling | E06B 9/40 |
| 11,339,609 | B2 * | 5/2022 | Ng | E06B 9/50 |
| 11,384,597 | B2 * | 7/2022 | Seiple | E06B 9/50 |
| 2008/0142171 | A1 * | 6/2008 | Koop | E06B 9/50 160/243 |
| 2010/0200179 | A1 * | 8/2010 | Di Stefano | E06B 9/42 160/368.1 |
| 2014/0084122 | A1 * | 3/2014 | Shevick | E04B 1/38 248/268 |
| 2014/0110212 | A1 * | 4/2014 | Ng | F16D 41/206 192/75 |
| 2018/0291682 | A1 * | 10/2018 | Walter-Seifart | E06B 9/68 |
| 2021/0071475 | A1 * | 3/2021 | Seiple | E06B 9/72 |

FOREIGN PATENT DOCUMENTS

| | | | | |
|---|---|---|---|---|
| GB | 2339820 | A * | 2/2000 | E06B 9/50 |

* cited by examiner

*Primary Examiner* — Beth A Stephan
(74) *Attorney, Agent, or Firm* — Lei Gao

(57) ABSTRACT

An idler end for roller blinds is provided. The idler end includes limiting counterparts such that the maximum length of the idler end may be adjusted. A method for using the idler end is also provided.

20 Claims, 9 Drawing Sheets

IDLER END FOR A ROLLER BLIND

CROSS REFERENCE TO RELATED APPLICATIONS

This application claims priority of Canadian patent application No. 3077999, filed on Apr. 10, 2020, the contents of which is incorporated herein by reference in their entirety.

TECHNICAL FIELD

This invention relates generally to roller blinds, or window shades, and in particular to an idler end for such devices.

BACKGROUND

Conventional idler end for roller blind has a constant length, making it difficult to install, significantly increasing the labor required to install the roller blinds or window shades. In addition, the constant length of the idler end also may make it impossible to adjust the gaps between the ends of the roller blinds and end bracket, thus affecting the artistic value of the roller blinds or window shades.

Thus, there is a need to provide an adjustable idler end.

SUMMARY

An idler end with adjustable length is provided. In some embodiments, the idler end includes a housing, a shaft, a bias member, a pin, and a limiter. The external surface of the housing is configured to engage the roller tube. The housing includes a housing cavity. The shaft is at least partially disposed in the housing cavity. A second limiting counterpart is configured on the exterior surface of the shaft. The pin is disposed in the shaft and at least one end of the pin is exposed from the shaft. A bias member is configured to engage the housing and the shaft, biasing the housing and the shaft away from each other. A limiter is connected to the housing. A first limiting counterpart is configured on the limiter. The first limiting counterpart and the second limiting counterpart cooperate to limit the movement of the shaft relative to the housing to a maximum predetermined distance. This maximum predetermined distance is adjustable. In some embodiments, for example, the maximum predetermined distance can be adjusted by movement of the limiter, which causes a relative movement between the first and second limiting counterparts. In some embodiments, the movement of the limiter is rotation.

In some embodiments, one of the first and second limiting counterparts include at least two surfaces and the other one of the first and second limiting counterparts include at least one protrusion. The surfaces and the protrusion are configured to engage each other such that the movement of the shaft and the limiter is limited. The surfaces are disposed at different positions such that when the protrusion engages different surfaces the movement of one of the shaft and the limiter relative to the other is limited to different maximum predetermined distances. In some embodiments, the protrusion is in the form of a ridge.

In some embodiments, the limiter includes a stem, and the first limiting counterpart is configured on the stem. In some embodiments, the stem includes a groove on its exterior surface. One or more positioning protrusion and/or one or more screw connects the limiter to the housing.

In some embodiments, the external surface of the housing is configured for interference fit with the interior surface of a roller tube. In some embodiments, at least two opposing projections are disposed on the external surface of the housing for interference fit with the interior surface of the roller tube.

In some embodiments, the shaft includes a cavity and the bias member is disposed in the housing cavity and the shaft cavity.

In some embodiments, the pin and the shaft are formed in one piece.

In some embodiments, the shaft includes a second shaft cavity, and the pin is disposed therein. The shaft includes an aperture and at least a portion of the pin is exposed from the shaft. In some embodiments, the pin and the shaft are rotatable relative to each other. In some embodiments, a damping material is disposed between the pin and the shaft. In some embodiments, a lubricant and/or a bearing is disposed between the pin and the shaft. For example, the bearing may include ball bearings.

In some embodiments, the limiter comprises a through-bore and at least a part of the shaft is extendable through the through-bore. And in some embodiments, the pin is exposable from the limiter.

The idler end may be made of metal, plastic, wood, or a combination thereof.

In some embodiments, the shaft and the housing can rotate relative to each other. In some embodiments, they are configured to reduce the noise when rotated. For example, a damping material may be disposed between the shaft and the housing. In some embodiments, a lubricant and/or a bearing is disposed between the shaft and the housing. For example, the bearing may include ball bearings.

In some embodiments, the shaft includes a first positioning counterpart and the housing comprises a second positioning counterpart, which cooperate such that the shaft and the housing rotate together. One of the first positioning counterpart and the second positioning counterpart may include at least one projection and the other may be configured with corresponding receptacle.

In some embodiments, the housing includes a third limiting counterpart that cooperates with the second limiting counterpart such that the movement of the shaft toward the housing is limited to a minimum predetermined distance. In some embodiments, the third limiting includes a shoulder.

In some embodiments, the shaft comprises at least one tooth at a portion distal from the housing.

A roller blind comprising the idler end is also disclosed.

A method for installing a roller blind is also disclosed. The method includes disposing the idler end in a roller tube, limiting the movement of the shaft relative to the housing to a first range, installing the roller blind, and limiting the movement of the shaft relative to the housing to a second range, which is different from the first range.

BRIEF DESCRIPTION OF THE DRAWINGS

Reference will now be made, by way of example, to the accompanying drawings which show example embodiments of the present application, and in which.

DETAILED DESCRIPTION

In various examples, the present disclosure describes an idler end 10 including a limiting system for limiting movement between a shaft and a housing, and the movement can be limited to different predetermined ranges. Although the present disclosure provides examples, the disclosed methods and devices may be suitable for other purposes, with modification as appropriate.

Figure 1:
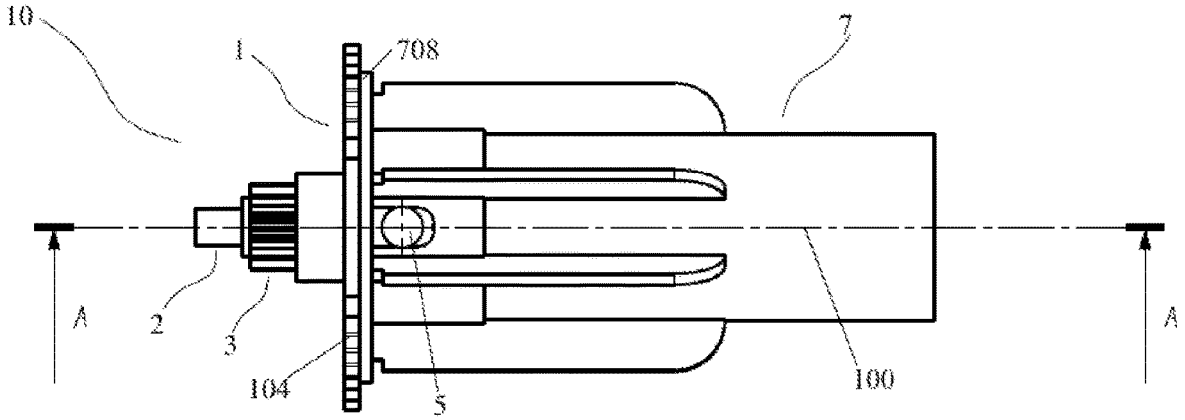
FIG. 1 is a side view of one embodiment of the idler end at a first predetermined length.
Figure 2:
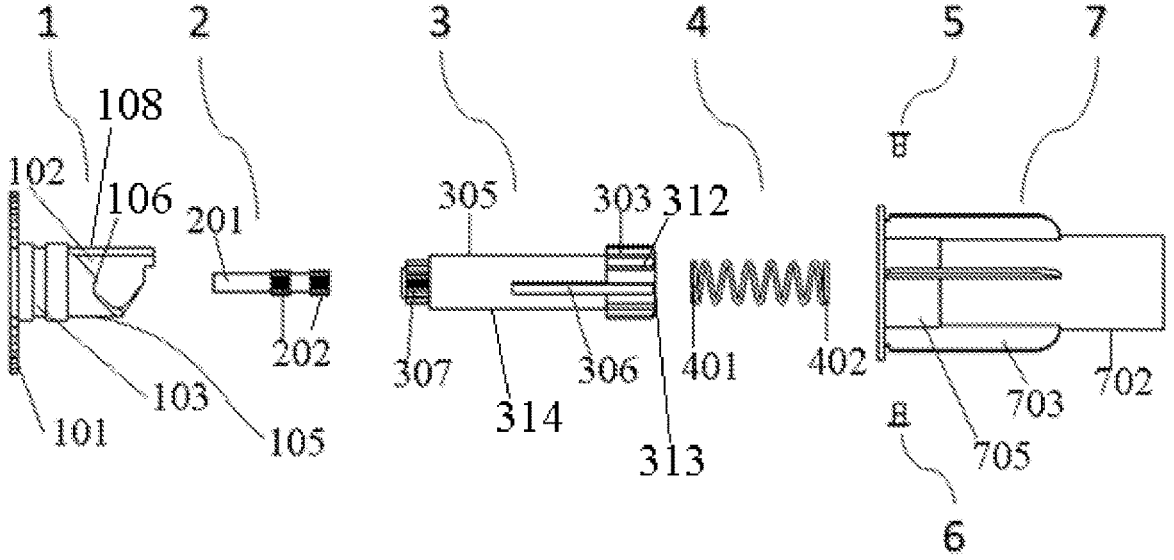
FIG. 2 is an exploded view of the idler end of FIG. 1.
Figure 3:
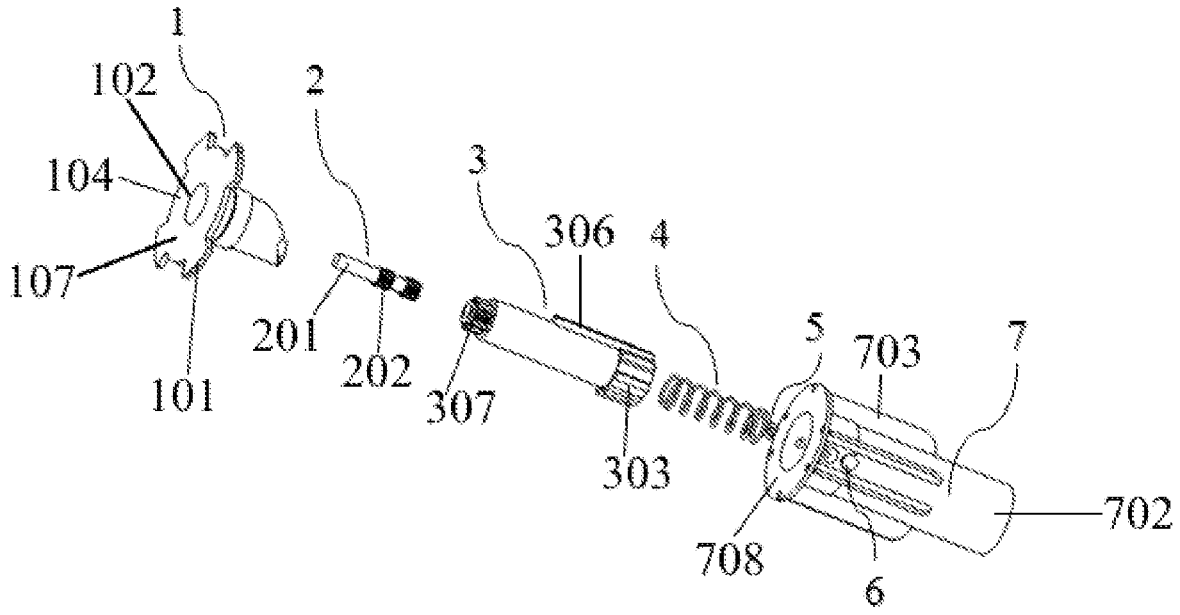
FIG. 3 is a perspective exploded view of the idler end of FIG. 1.

Reference is now made to FIGS. 1, 2, and 3. The idler end includes a limiter 1, a pin 2, a shaft 3, a bias member 4, positioning pins 5 and 6, and a housing 7.

For the ease of description, a longitudinal direction 100 is shown in FIG. 1. However, this does not necessarily mean that the dimension along this direction is larger than the dimensions in other directions.

The limiter 1 includes a flange 104. In some embodiments, one or more projections 101 extend from the edge of the flange 104 to function as handles. In some embodiments, grooves are disposed on the outer edge of the projections 101 to facilitate engagement with the projections 101 to make it easier to move the projections 101. In some embodiments, the flange 104 is disposed at the end 107 of the limiter 1. In some embodiments, the limiter 1 does not include a flange 104 and the one or more projections 101 extend from the exterior surface of the through-bore 102.

The limiter 1 includes a stem 105. In some embodiments, a groove 103 is disposed around the exterior surface 108 of the stem 105. In some embodiments, the groove 103 is circumferential around the stem 105. In some embodiments, the groove 103 is around a portion of the circumference of the stem 105. In some embodiments, the stem 105 is cylindrical. The stem 105 is hollow, and a through-bore 102 is formed in the stem 105 through the limiter 1. In some embodiments, a first limiting counterpart 106 is disposed on the stem 105. In some embodiments, the first limiting counterpart 106 includes more than one limiting portions.

The pin 2 includes a pin part 201. In some embodiments, the pin part 201 is cylindrical. In some embodiments, the pin also comprises one or more enlarged portions 202. In some embodiments, the enlarged portion 202 surrounds the pin part 201 circumferentially. In some embodiments, the enlarged portion 202 is disposed at various positions on the outer surface of the pin part 201. In some embodiments, the enlarged portion 202 includes a damping material.

The shaft 3 comprises a shaft body 305. The shaft 3 has an exterior surface 314. A second limiting counterpart 306 is disposed on the external surface 314. The first limiting counterpart 106 and the second limiting counterpart 306 are configured to cooperate with each other to limit the relative movement between the shaft 3 and the limiter 1. In some embodiments, the first limiting counterpart 106 and the second limiting counterpart are configured to engage with each other. By change the portions of the first limiting counterpart 106 and/or the second limiting counterpart 306 that engage, the movement between the shaft 3 and the limiter 1 may be restricted to different extent. In some embodiments, the second limiting counterpart 306 is a protrusion. In some embodiments, the protrusion is in the form of a ridge extending along the length of the shaft body 305.

In some embodiments, the shaft 3 includes an enlarged portion 303. In some embodiments, the enlarged portion 303 is disposed at one end 313 of the shaft body 305. In some embodiments, the shaft 3 also includes a shaft cap 307. In some embodiments, the enlarged portion 303 is configured to reduce the vibration of the shaft 3 when the shaft 3 is rotated and/or to reduce the vibration of the idler end 10 when it rotates. In some embodiments, the enlarged portion 303 includes first positioning counterpart 312. In some embodiments, the shaft cap 307 includes at least one tooth, such that the rotational force of the shaft 3 can be transferred to a counterpart device. In some embodiments, a force maybe applied to 307 such that the idler end 10 rotates.

The bias member 4 is configured to engage the housing 7 and the shaft 3 and exert a biasing force when compressed. In some embodiments, the bias member 4 is a spring, for example, a helical spring. In some embodiments, the bias member 4 comprises a resilient structure. In some embodiments, the bias member 4 comprises a resilient material, for example, an elastomer. In some embodiments, the bias member 4 has a first end 401 and a second end 402. The first end 401 is configured to engage the shaft 3 and the second end 402 is configured to engage the housing 7. In some embodiments, the bias member 4 is configured to engage the shaft 3 and the housing 7 at portions away from the ends.

The housing 7 includes an external surface 702. In some embodiments, the external surface 702 is configured for interference fit with the interior surface of a roller tube. In some embodiments, at least two opposing projections 703 are configured on the external surface 702, and the projections 703 are configured for interference fit with the interior surface of a roller tube. In some embodiments, the housing 7 includes a sidewall 705. In some embodiments, the projections 703 extends along the longitudinal direction. In some embodiments, each projection 703 is in a form similar to a fin.

In some embodiments, the housing 7 further includes a flange 708.

In some embodiments, the limiter 1 is connected to the housing 7 using positioning pins 5 and 6 extending inwardly from the housing 7. A portion of each of the positioning pins 5 and 6 are disposed in the groove 103 such that the movement of the limiter 1 is longitudinally restricted relative to the housing 7, while as the same time at least one of the limiter 1 and the housing 7 can rotate relative to the other. In some embodiments, one positioning pin 5 is used. In some embodiments, 3, 4, 5, 6, 7, 8, 9, or more positioning pins are used. In some embodiments, the positioning pin 5 or 6, independently, may be in the form of screws. In some embodiments, some of the positioning pins are in the form of screws while some other positioning pins are in the form of retractable pins. In some embodiments, when the housing 7 and the limiter 1 are connected, the flange 104 is disposed adjacent to or in contact with the flange 708. In some embodiments, at least one of the screws is driven through the sidewall 705 of the housing 7

Each of the limiter 1, pin 2, shaft 3, bias member 4, positioning pins 5, 6, and the housing 7 may be made of metal, plastic, rubber, wood, or other suitable material, or a combination thereof.

Figure 4:
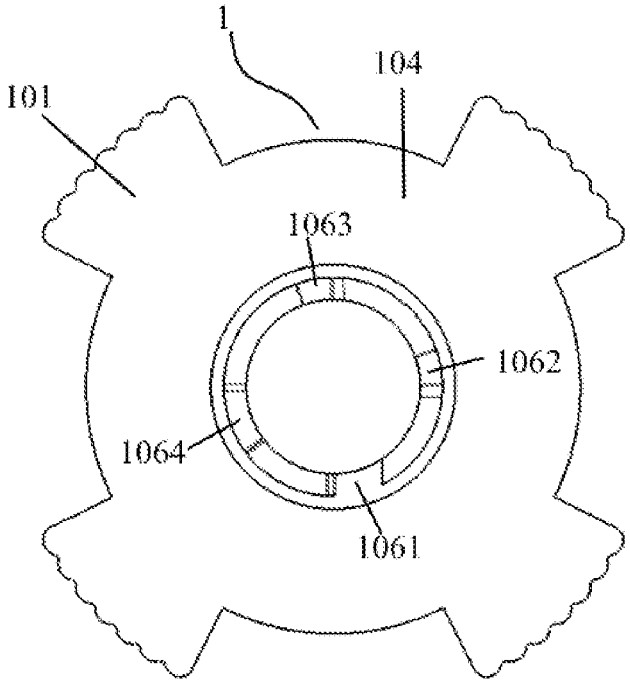
FIG. 4 is a top view of one embodiment of the limiter.
Figure 5:
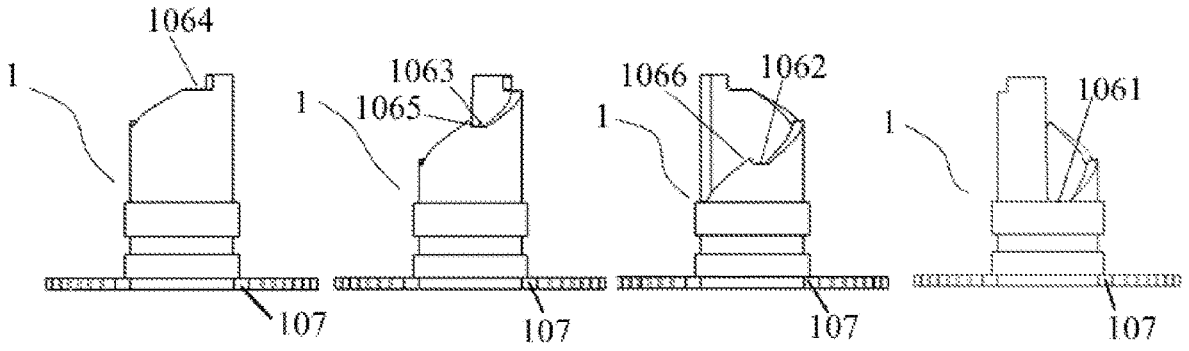
FIG. 5 is a side view of the limiter of FIG. 4.
Figure 6:
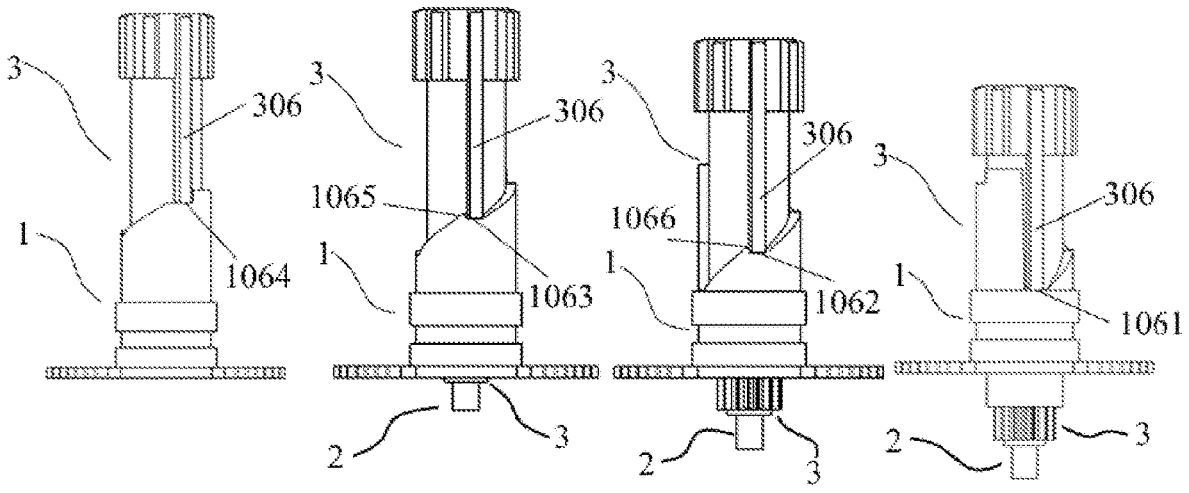
FIG. 6 is a side view of one embodiment of the shaft engaging the limiter of FIG. 4.

Reference is now made to FIGS. 4 to 6. The first limiting counterpart 106 includes four surfaces 1061, 1062, 1063, and 1064 configured to engage the second limiting counterpart 306. FIG. 5 shows that the four surfaces 1061, 1062, 1063, and 1064 are disposed at different distances from the end 107 of the limiter 1. When one of the surfaces 1061, 1062, 1063, and 1064 engages the second limiting counterpart 306, the movement of the shaft 3 with respect to the limiter 1 is limited to different maximum distances. In some embodiments, protrusions, for example blocking protrusions 1065 and 1066, are disposed adjacent to the surfaces 1062 and 1063, respectively. In some embodiments, the protrusions help to hinder unintentional disengagement between the first limiting counterpart 106 and the second limiting counterpart 306. In some embodiments, the first limiting counterpart 106 and the second limiting counterpart 306 may be configured for frictional contact therebetween such that the unintentional disengagement therebetween is hindered.

In some embodiments, the first limiting counterpart 106 includes one or more protrusions, and the second limiting counterpart 306 includes more than one surfaces configured to engage the one or more protrusions of the first limiting counterpart 106 such that the first limiting counterpart 106 and the second limiting counterpart 306 can cooperate to limit the movement of the shaft 3 relative to the limiter 1.

In some embodiments, the first limiting counterpart 106 includes more or fewer than four surfaces for engaging the limiting counterpart 306 and the protrusions may be disposed next to one or more of the surfaces, such that movement of the shaft 3 relative to the limiter 1 can be limited to various numbers of different predetermined distances. In some embodiments, the first limiting counterpart 106 and/or the second limiting counterpart 306 are configured such that number of predetermined distances that the shaft 3 can move with respect to the housing 7 or the limiter 1 is infinite, i.e., the adjustment of the predetermined distances is stepless.

In some embodiments, a portion of the limiter 1 is moveable, for example, rotatable, such that a different portion of the first limiting counterpart 106 engages the second limiting counterpart 306, such that the distance in which the shaft 3 can move relative to the limiter 1 is adjusted. As the first limiting counterpart 106 moves, for example, relative to the second limiting counterpart 306, different surface of the first limiting counterpart 106 engages the second limiting counterpart 306. For example, FIG. 6 shows the surfaces 1061, 1062, 1063, and 1064 engaging the second limiting counterpart 306, and different lengths of the pin 2 and shaft 3 are exposed from the limiter 1.

In some embodiments, the limiter 1 as a whole moves as a result of a movement of the limiter 1, thus effecting the relative movement of the first limiting counterpart 106 and the second limiting counterpart 306 such that a different portion of the first limiting counterpart 106 engages the second limiting counterpart 306, thus the distance that the shaft 3 can move toward the limiter 1 is adjusted. For example, FIG. 6 shows the surfaces 1061, 1062, 1063, and 1064 engaging the second limiting counterpart 306, and different lengths of the pin 2 and the shaft 3 are exposed from the limiter 1. In some embodiments, the movement of the limiter 1 may be rotation. In some embodiments, moving the limiter 1 is effected by exerting a force on the projections 101.

In the embodiments where a protrusion is disposed adjacent to at least one of the surfaces 1061, 1062, 1063, and 1064, a stronger force is required to move the first limiting counterpart 106 such that a different surface of the first limiting counterpart 106 can engage the second limiting counterpart 306. In some embodiments, the shaft 3 may be pushed away from the limiter 1, thus the second limiting counterpart 306 disengages from the first limiting counterpart 106, allowing at least one of the first limiting counterpart 106 and the second limiting counterpart 306 to move, for example, rotate, relative to the other such that a different portion of the first limiting counterpart 106 and the second limiting counterpart 306 can engage.

Reference is now made to FIGS. 1, and 7 to 15.

The housing 7 has a housing cavity 701 and the shaft has a shaft cavity 301. The bias member 4 is disposed in the housing cavity 701 and the shaft cavity 301, exerting a force to bias the shaft 3 away from the housing, for example, with respect to the longitudinal direction 100.

In some embodiments, the shaft 3 does not have a shaft cavity 301 and the bias member 4 engages the shaft 3 and the housing. For example, the bias member 4 may be received in the housing cavity 701 and one end of the bias member 4 engages one end of the shaft 3.

In some embodiments, at least one of the shaft 3 and the housing 7 can rotate relative to the other. In some embodiments, for example, the portion of the outer surface 311 and the portion of the interior surface 710 of the housing that are adjacent to or in contact with each other may be complementarily shaped to facilitate the rotation relative to each other. For example, the portion of the outer surface 311 and the portion of the interior surface 710 of the housing that are adjacent to or in contact with each other may both be cylindrical, and have a common axis that is, for example, parallel to the longitudinal direction 100. In some embodiments, a damping material 314 is disposed between the shaft 3 and the housing 7, for example, to reduce the noise when at least one of the shaft 3 and the housing 7 rotates relative to the other. In some embodiments, a lubricant and/or bearing is disposed between the shaft 3 and the housing 7. For example, the bearing may include ball bearings.

Figure 10:
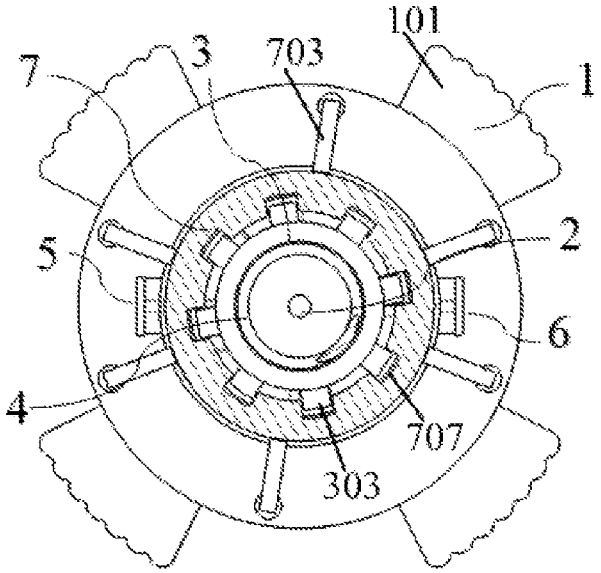
FIG. 10 is a sectional view with respect to the A-A line in FIG. 9.

In some embodiments, the housing 7 and the shaft 3 cannot rotate relative to each other. In some embodiments, for example, the enlarged portion 303 includes a first positioning counterpart 312 and the housing 7 includes a second positioning counterpart 707, which are complementarily designed. For example, the first positioning counterpart 312 may be in the form of one or more projections and the second positioning counterpart may be in the form of one or more corresponding receptacles. The projection may be in the form of a ridge and the receptacle may be in the form of a groove, as shown in FIG. 10. As such, when the first positioning counterpart 312 engages the second positioning counterpart 707, the shaft 3 and the housing 7 cannot rotate relative to each other. In some embodiments, the second positioning counterpart 707 is in the form of one or more projections and the first positioning counterpart 312 may be in the form of one or more corresponding receptacles. When each of the positioning counterparts 312 and 707 comprises more than one ridges or grooves, respectively, there is inherent redundancy such that when one of the ridges or grooves fail, the system may still function as desired. In some embodiments, the first positioning counterpart 312 may also at least partially relieve the stress on the second limiting counterpart 306.

In some embodiments, the housing 7 includes an engager 711 that engages one end of the bias member 4 such that the movement of the bias member 4 relative to the housing 7 is restricted at this end. In some embodiments, the engager 711 is in the form of a solid bottom 712. In some embodiments, the engager 711 is in the form of a ridge or a series of protrusions. In some embodiments, the engager 711 is disposed at a position away from the bottom 712 of the housing 7. In some embodiments, the shaft 3 includes an engager 302 in the cavity 301 such that the movement of the other end of the bias member 4 is restricted relative to the shaft 3. In some embodiments, the engager 302 is disposed at an end of the cavity 301. In some embodiments, the engager 302 is in the form of a shoulder. In some embodiments, the engager 302 is in the form of a continuous or discontinuous circumferential ridge.

In some embodiments, the maximum distance the shaft 3 can move toward the limiter 1 is such that the bias member 4 no longer exerts a force on the shaft 3 because the distance between the shoulder 312 and the engage 711 is larger than the length of the bias member 4.

Figure 7:
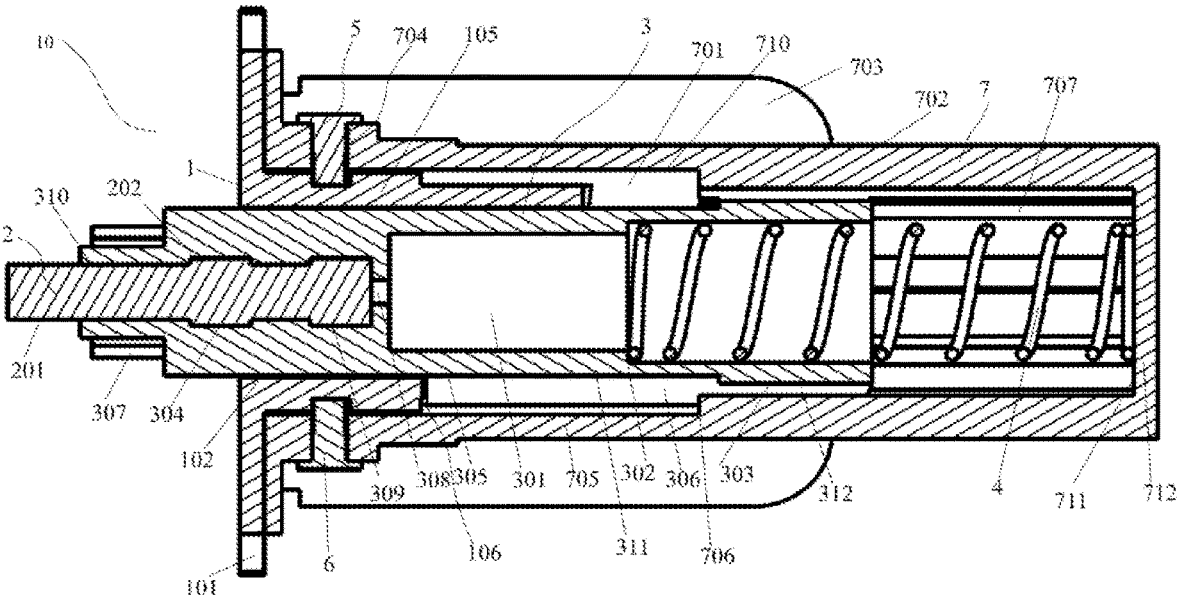
FIG. 7 is a sectional view of the idler end of FIG. 1.

In some embodiments, the housing 7 includes a third limiting counterpart 706 as shown in FIG. 7, which is configured to engage the second limiting counterpart 306 such that the movement of the shaft 3 toward the housing 7 is limited, thus defining a minimum distance between a certain point of the shaft 3 and a certain point of the housing 7, for example, between the enlarged portion 303 of the shaft 3 and the engager 711 of the housing 7. In some embodiments, the third limiting counterpart is in the form of a shoulder or a protrusion.

Figure 15:
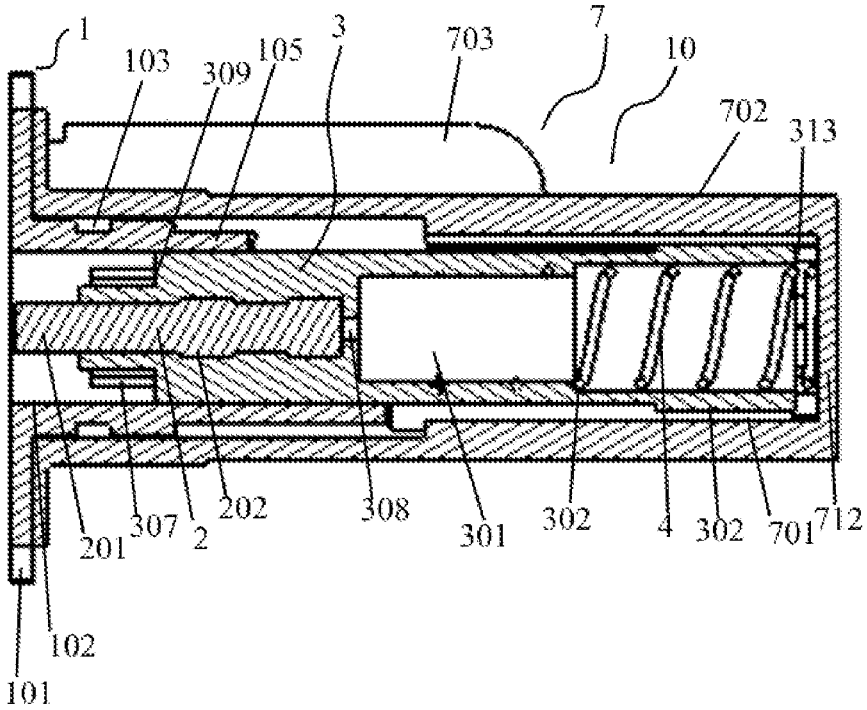
FIG. 15 is a sectional view of one embodiment of the idler end of FIG. 14.

In some embodiments, the shaft 3 can be pushed into the housing 7 such that the end 313 of the shaft 3 is adjacent to the bottom 712 of the housing 7 as shown in FIG. 15, defining a minimum distance between a certain point of the shaft and a certain point of the housing 7. In some embodiments, for example, a third limiting counterpart 706 is not configured on the housing 7. In some embodiments, the second positioning counterpart 707 may be configured to receive the second limiting counterpart 306, thus allowing the shaft 3 to be pushed all the way into the housing cavity 701

The limiter 1 is connected to the housing 7 at or close to an end of the housing 7 distal from the housing bottom 712. In some embodiments, the flange 104 of the limiter 1 is disposed adjacent to the flange 708 of the housing 7. In some embodiments, positioning pins are used to attach the limiter 1 to the housing 7 by insertion into the groove 103 of the limiter 1 as discussed in this disclosure.

In some embodiments, at least a portion of the outer surface 311 of the shaft 3 is configured to be adjacent to or in contact with the interior surface of the through-bore 102 of the limiter 1. In some embodiments, the shaft 3 extends through the through-bore 102 such that at least a portion of the shaft 3 is exposed from the limiter 1. In some embodiments, the through-bore 102 and the outer surface 311 are complementarily shaped. For example, the through-bore 102 and the outer surface 311 may both be cylindrical. In some embodiments, at least one of the shaft 3 and the limiter 1 can rotate relative to the other around, for example, a common axis that is parallel to the longitudinal direction 100. In some embodiments, the shaft 3 and the limiter 1 cannot rotate relative to each other.

The first limiting counterpart 106 engages the second limiting counterpart 306 such that the movement of the shaft 3 away from the housing 7 or toward the limiter 1 is limited to a predetermined maximum distance. By a movement of the first limiting counterpart 106 and the second limiting counterpart 306 relative to each other, the predetermined maximum distance can be adjusted because different portions of the first limiting counterpart 106 engages the second limiting counterpart 306, or vice versa. For example, the movement of at least one of the first limiting counterpart 106 and the second limiting counterpart 306 relative to the other may be as discussed with respect to FIGS. 4 to 6 in this disclosure.

Figure 8:
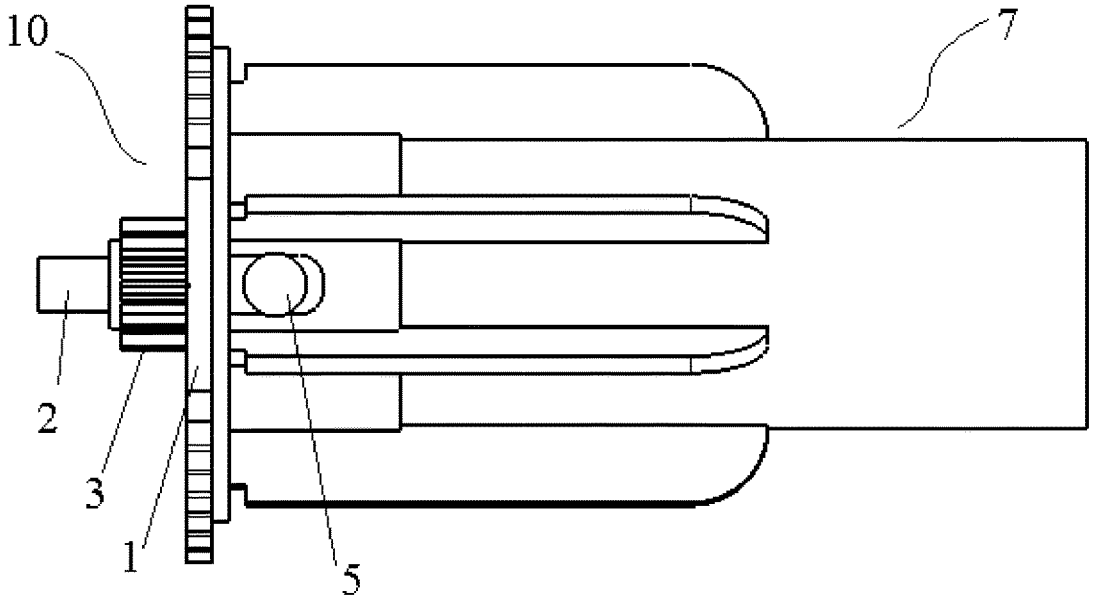
FIG. 8 is a side view of one embodiment of the idler end at a second predetermined length.
Figure 9:
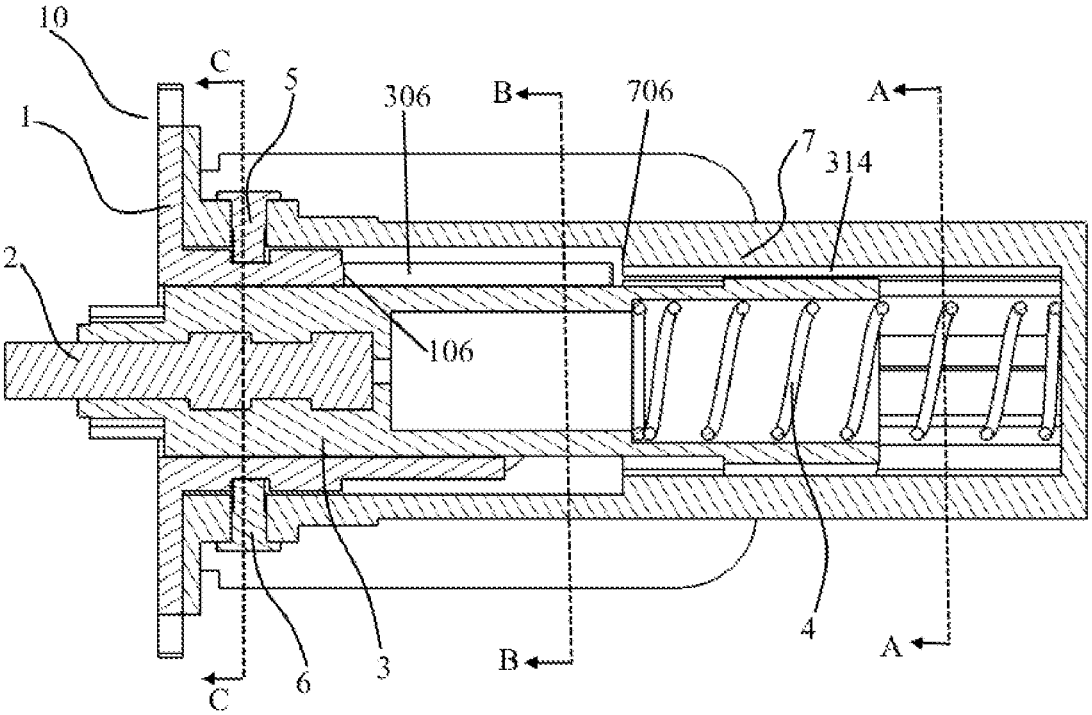
FIG. 9 is a sectional view of the idler end of FIG. 8.
Figure 11:
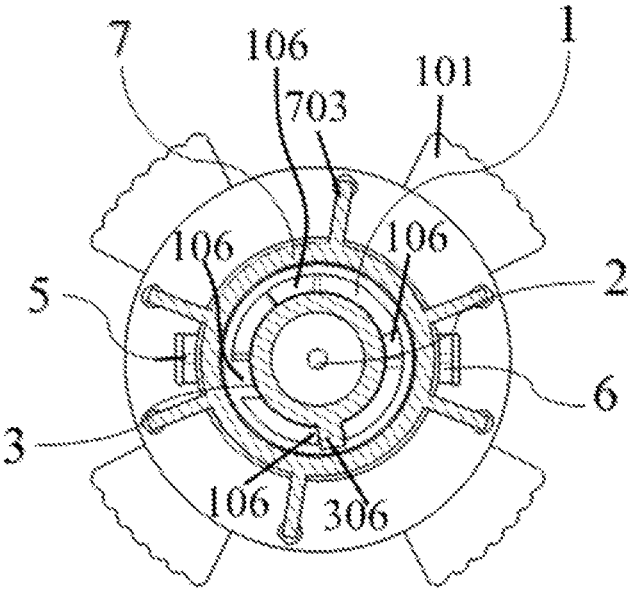
FIG. 11 is a sectional view with respect to the B-B line in FIG. 9.

FIG. 9 shows a sectional view of the idler end 10 at the length as shown as shown in FIG. 8. Here, a different portion of the first limiting counterpart 106 engages the second limiting counterpart 306 such that a shorter portion of the shaft 3 is exposed from the limiter 1 as compared to the configuration of the idler end 10 as shown in FIGS. 1 and 7. As shown in FIG. 11, the second limiting counterpart 306 engages a portion of the first limiting counterpart 106.

In some embodiments, the pin 2 is received in a cavity 309 of the shaft 3. In some embodiments, the enlarged portion 202 are received in recess 304 in the shaft. In some embodiments, the enlarged portion 202 fits snugly on the pin part 201, thus the longitudinal movement of the pin part 201 relative to the shaft 3 is restricted. For example, the shaft 3 may be constructed in two halves. After the pin 2 is placed in one half, the other half is placed on the one half in a fashion similar to a clamshell. In some embodiments, the enlarged portion 303 and the shaft cap 307 are placed on the outer surface 311 of the shaft 3 such that the two halves of the shaft 3 are held together. The pin 2 extends through the aperture 310 such that at least a portion of the pin 2 is exposed from the shaft 3. In some embodiments, the pin 2 is disposed in a mold for fabricating the shaft 3 before or after the material for forming the shaft 3 is disposed in the mold. When the shaft 3 is formed, the pin 2 is disposed in the shaft 3.

In some embodiments, the pin 2 and the cavity 309 are shaped such that the pin 2 is rotatable relative to the shaft 3. For example, the pin part 201 and the cavity 309 may be complementarily shaped, and the pin 2 and the shaft 3 can rotate relative to each other around a common axis. For example, they may both be cylindrical. In some embodiments, the common axis may be parallel to the longitudinal direction 100 of the idler end 10. In some embodiments, the enlarged portion 202 comprises a damping material, which can, for example, reduce the noise when the pin 2 and the shaft 3 rotate relative to each other. In some embodiments, a lubricant and/or a bearing is disposed between the pin 2 and the shaft 3. For example, the bearing may include ball bearings.

Figure 12:
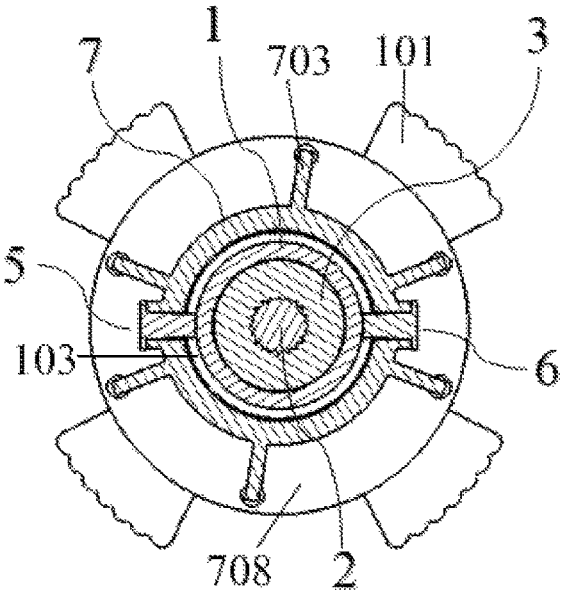
FIG. 12 is a sectional view with respect to the C-C line in FIG. 9.
Figure 13:
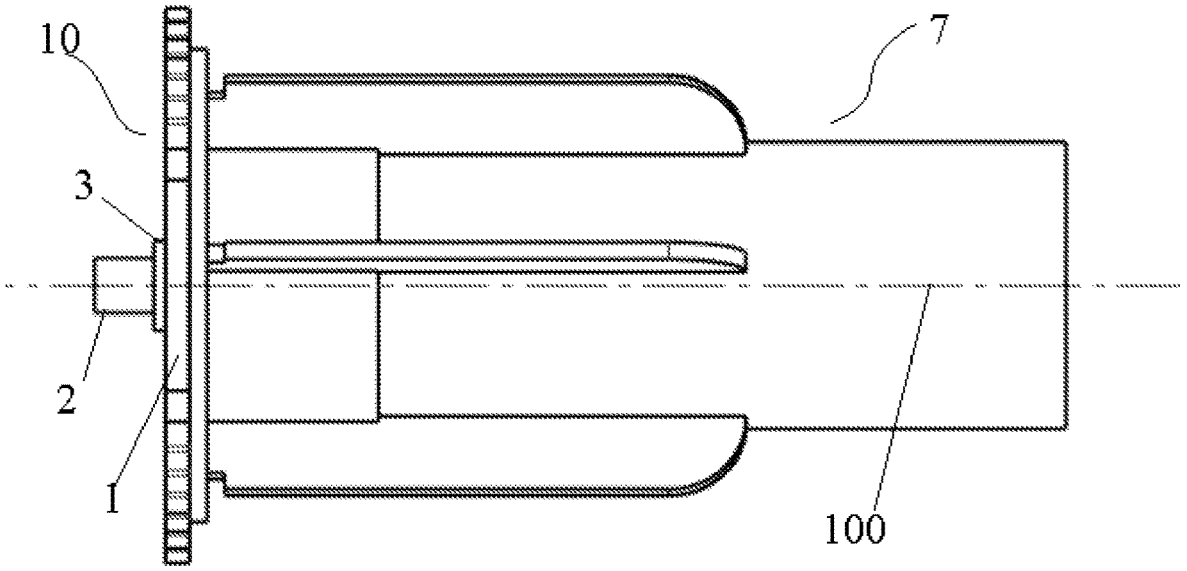
FIG. 13 is a side view of the idler end of at a third predetermined length.

In some embodiments, the pin 2 and the shaft 3 cannot rotate relative to each other. For example, the pin 2 and the shaft 3 may be manufactured in one piece. For example, a portion of the pin 2 and a portion of the cavity 309 may be complementarily configured that that the rotational movement between the pin 2 and the shaft 3 are restricted as shown in FIG. 12. For examples, the pin 2 and the shaft 3 may be configured with complementary ridges and grooves.

In some embodiments, the cavity 301 and the cavity 309 are in mass communication through an aperture 308.

In some embodiments, when the shaft 3 is pushed into the housing 3, the pin 2 is not exposed from the limiter 1, as shown in FIG. 15. In some embodiments, the pin 2 is not exposed from the limiter 1 because of the position of the shaft 3 as limited by the cooperation between the first limiting counterpart 106 and the second limiting counterpart 306. For example, the second limiting counterpart 306 may be engaged to the surface 1064 of the first limiting counterpart 106 as shown in FIG. 6.

FIGS. 1, 8, 13, and 14 show the different total maximum lengths of the idler end 1, which is effected by the bias member 4 biasing the shaft to the predetermined maximum distance the shaft 3 is allowed to move away from the housing 7 effected by the cooperation between the first limiting counterpart 106 and the second limiting counterpart 306 when there is no force exerted on the shaft 3 opposite the force exerted by the bias member 4. The total maximum lengths are thus adjustable by adjusting the predetermined maximum distance the shaft 3 can move relative to the housing 7. For example, the different total maximum lengths of the idler end 10 may be the result of different engagements between the first limiting counterpart 106 and the second limiting counterpart 306 as shown in FIG. 6, where the second limiting counterpart 306 engages the different surfaces 1061, 1062, 1063, and 1064 of the first limiting counterpart 106, respectively. The predetermined maximum distances and the minimum distance define the predetermined distance ranges within which the shaft 3 can move. In some embodiments, a force may be exerted on the shaft 3 to counter the force exerted by the bias member 4 such that the shaft 3 moves within the predetermined distance range. In some embodiments, the movement of the shaft 3 within each predetermined distance range is stepless, resulting in infinite numbers of possible total lengths of the idler end 10 corresponding to each predetermined distance range.

Figure 16:
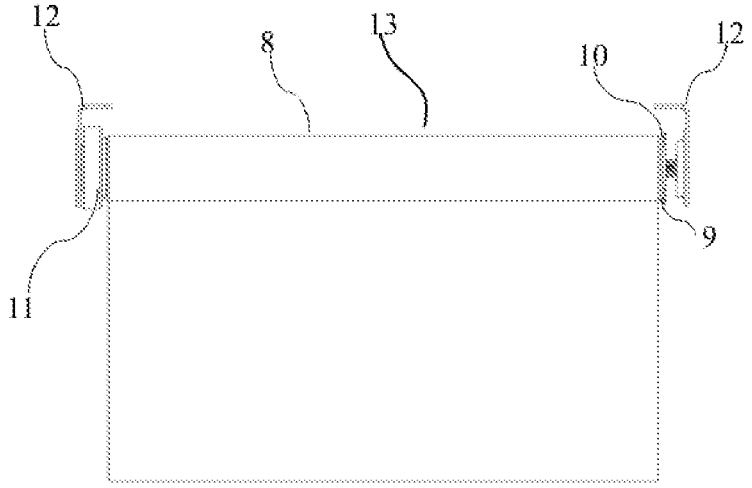
FIG. 16 is a side view of a roller blind including an embodiment of the idler end of this disclosure.
Figure 17:
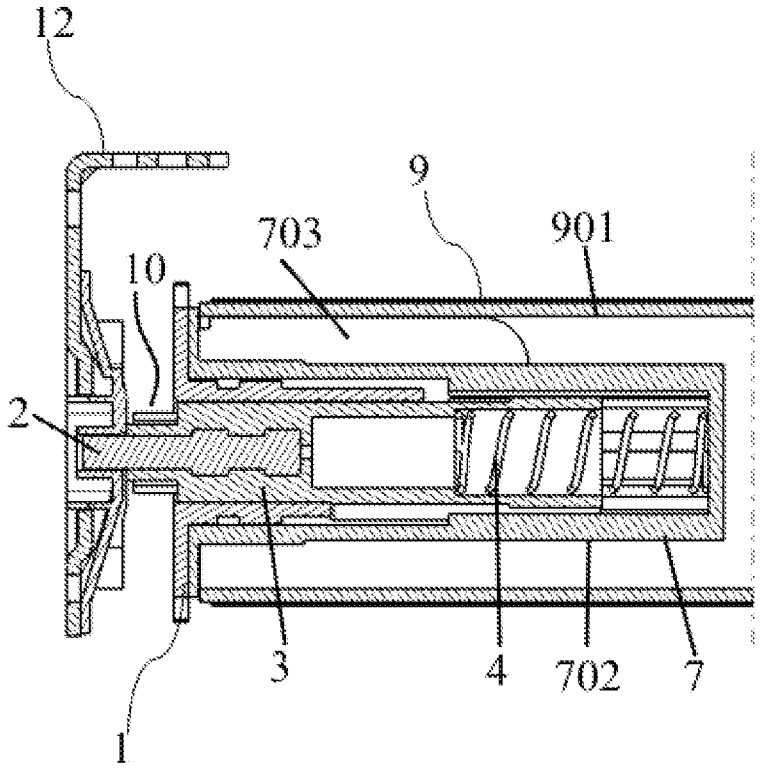
FIG. 17 is a sectional view of the roller blind of FIG. 12.

Reference is now made to FIGS. 16-17. FIG. 16 shows one embodiment of a roller blind 13 that includes the idler end 10 of this disclosure. The idler end 10 is installed at one end of the roller tube 9 and engages a bracket 12. A blind 8 is installed on the roller tube 9. Another idler end 11 is installed at the other end of the roller tube 9 and engages another bracket 12. The idler end 11 may be the same or different from the idler end 10 of this disclosure. When the roller tube 9 rotates, the blind 8 is retracted or extended depending on the direction of the rotation of the roller tube 9 and the direction of installation of the blind 8 on the roller tube 9.

FIG. 17 shows a sectional view of the idler end 10 installed in the roller tube 9. The projection 703 engages the interior surface 907 of the roller tube 9 such that the housing 7 and the roller tube 9 rotate together. In some embodiments, the external surface 702 of the housing 7 engages the interior surface 901 of the roller tube 9.

The pin 2 is received in the bracket 12. In some embodiments, the pin 2 rotates relative to the bracket 12 such that the idler end 10 rotates. In some embodiments, the idler end 10 rotates by having the shaft 3 and the pin 2 rotate relative to each other. In some embodiments, the idler end 10 rotates by having the housing 7 and the shaft 3 rotate relative to each other.

In some embodiments, for example, the projections 101 include a handle to facilitate movement of the limiter 1. In some embodiments, the handle is disposed in the gap between the bracket 12 and the limiter 1.

Figure 14:
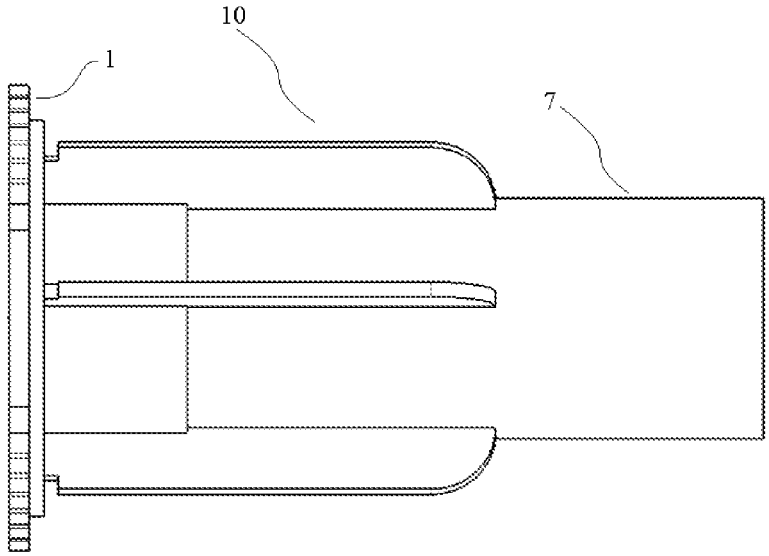
FIG. 14 is a side view of one embodiment of the idler end at a fourth predetermined length.

A method for installing the roller bind 13 including the idler end 10 of this disclosure is also provided. The idler end 10 is installed in the roller tube 9. The limiter 1 is moved to a position such that the shaft 3 retracts into the housing 7 such that the pin 2 is not exposed from the idler end 10, for example, as shown in FIG. 14. The pin 2 can be retracted into the idler end 10 before or after the idler end 10 is installed in the roller tube 9. The roller tube 9 is then positioned at a predetermined position. Then the limiter 1 is moved such that the pin 2 is exposed from the idler end 10. Depending on the distance between the idler end 10 and bracket 12, the limiter 1 is moved to different positions such that the first limiting counterpart 106 and the second limiting counterpart 306 move relative to each other, allowing the pin 2 to extend to an appropriate length such that pin 2 engages the bracket 12. For example, the first limiting counterpart 106 and the second limiting counterpart 306 can move relative to each other such that the adjusted predetermined distance range corresponds to a range of length of the idler end 10 that includes the length required for the pin 2 to engage the bracket 12. The bias member 4 then pushes the shaft 3, and in turn, the pin 2 toward the bracket 12 until the pin 2 engages the bracket 12, and the engagement between the pin 2 and the bracket 12 prevents further extension of the idler end 10.

The preceding discussion provides many example embodiments. Although each embodiment represents a single combination of inventive elements, other examples may include all suitable combinations of the disclosed elements. Thus if one embodiment comprises elements A, B, and C, and a second embodiment comprises elements B and D, other remaining combinations of A, B, C, or D, may also be used.

The term "connected" or "coupled to" may include both direct coupling (in which two elements that are coupled to each other contact each other) and indirect coupling (in which at least one additional element is located between the two elements).

Although the embodiments have been described in detail, it should be understood that various changes, substitutions and alterations can be made herein.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized. Accordingly, the appended claims are intended to include within their scope such processes, machines, manufacture, compositions of matter, means, methods, or steps.

The invention claimed is:

1. An idler end, the idler end comprising:

a housing, the housing
- defining a longitudinal direction, and
- comprising an interior surface that defines a housing cavity;

a limiter movably connected to the housing, the limiter comprising a first limiting counterpart, and a movement of the limiter relative to the housing is restricted in the longitudinal direction;

a shaft at least partially disposed in the housing cavity, the shaft comprising
- an exterior surface, and
- a second limiting counterpart disposed on the exterior surface; and a bias member that engages the housing and the shaft, and the bias member is configured to bias at least one of the shaft and the housing away from the other one of the shaft and the housing with respect to the longitudinal direction;

wherein the second limiting counterpart and the first limiting counterpart cooperatively limit a movement of the shaft relative to the housing to a maximum predetermined distance in the longitudinal direction, and the maximum predetermined distance is adjustable; and wherein the shaft comprises a first shaft cavity and the bias member is disposed in the housing cavity and the first shaft cavity.

2. The idler end of claim 1, wherein the shaft and the housing are configured such that they rotate together.

3. A roller blind comprising the idler end of claim 1.

4. The idler end of claim 1, wherein the maximum predetermined distance is adjusted by a movement of the first limiting counterpart, effected by a movement of the limiter, relative to the second limiting counterpart.

5. The idler end of claim 4, wherein the movement of the limiter is rotation.

6. The idler end of claim 4, wherein the second limiting counterpart comprises a protrusion on the exterior surface of the shaft and the first limiting counterpart comprises at least two surfaces disposed at different distances from an end of the limiter with respect to the longitudinal direction, each of the surfaces adapted to engage the protrusion when the protrusion is aligned with the surface.

7. The idler end of claim 6, wherein the protrusion is a ridge extending with respect to the longitudinal direction.

8. The idler end of claim 6, wherein a blocking protrusion is disposed adjacent at least one of the surfaces.

9. The idler end of claim 6, wherein the first limiting counterpart comprises four surfaces, each disposed at different distances from the end of the limiter.

10. The idler end of claim 4, wherein the first limiting counterpart comprises a protrusion and the second limiting counterpart comprises at least two surfaces disposed at different distances from an end of the shaft with respect to the longitudinal direction, each of the surfaces adapted to engage the protrusion when the protrusion is aligned with the surface.

11. The idler end of claim 1, wherein the limiter comprises a stem extending into the housing cavity, and the first limiting counterpart is disposed on the stem.

12. The idler end of claim 11, wherein the stem comprises an exterior surface, the exterior surface comprises a circumferential groove, and at least one positioning pin extends from the interior surface of the housing into the circumferential groove.

13. The idler end of claim 1, wherein the limiter comprises a through-bore and at least a part of the shaft is extendable through the through-bore.

14. The idler end of claim 13, wherein the shaft comprises a second shaft cavity, a pin is disposed in the second shaft cavity, and the pin extends through an aperture defined by the second shaft cavity such that at least a portion of the pin is exposed from the shaft.

15. The idler end of claim 14, wherein at least a portion of the portion of the pin that is exposed from the shaft is exposable from the limiter through the through-bore.

16. The idler end of claim 1, wherein the housing is rotatable around a longitudinal axis of the idler end relative to the shaft.

17. An idler end, the idler end comprising:

a housing, the housing defining a longitudinal direction, and comprising an interior surface that defines a housing cavity;

a limiter movably connected to the housing, the limiter comprising a first limiting counterpart, and a movement of the limiter relative to the housing is restricted in the longitudinal direction; and a shaft at least partially disposed in the housing cavity, the shaft comprising an exterior surface, and a second limiting counterpart disposed on the exterior surface;

wherein the second limiting counterpart and the first limiting counterpart cooperatively limit a movement of the shaft relative to the housing to a maximum predetermined distance in the longitudinal direction, and the maximum predetermined distance is adjustable;

the limiter comprises a through-bore and at least a part of the shaft is extendable through the through-bore; and the shaft comprises a second shaft cavity, a pin is disposed in the second shaft cavity, and the pin extends through an aperture defined by the second shaft cavity such that at least a portion of the pin is exposed from the shaft.

18. The idler end of claim 17, wherein at least a portion of the portion of the pin that is exposed from the shaft is exposable from the limiter through the through-bore.

19. The idler end of claim 17, wherein the maximum predetermined distance is adjusted by a movement of the first limiting counterpart, effected by a movement of the limiter, relative to the second limiting counterpart.

20. The idler end of claim 19, wherein the second limiting counterpart comprises a protrusion on the exterior surface of the shaft and the first limiting counterpart comprises at least two surfaces disposed at different distances from an end of the limiter with respect to the longitudinal direction, each of the surfaces adapted to engage the protrusion when the protrusion is aligned with the surface.

* * * * *